US006881128B1

(12) United States Patent
Natsuhara et al.

(10) Patent No.: US 6,881,128 B1
(45) Date of Patent: Apr. 19, 2005

(54) CERAMICS BASE PLATE AND METHOD FOR PRODUCING THE SAME

(75) Inventors: Masuhiro Natsuhara, Itami (JP); Hirohiko Nakata, Itami (JP)

(73) Assignee: Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 09/342,537

(22) Filed: Jun. 29, 1999

(30) Foreign Application Priority Data

Jul. 10, 1998 (JP) ..... 10-195725

(51) Int. Cl.[7] ..... B24B 1/00; B28D 1/02

(52) U.S. Cl. ..... 451/41; 125/12; 125/23.01; 125/30.01; 225/2; 451/54

(58) Field of Search ..... 451/41, 54; 125/23.01, 125/23.02, 38, 39, 12, 13.01, 15, 18, 24, 30.01; 225/2, 96, 96.5

(56) References Cited

U.S. PATENT DOCUMENTS 3,542,266 A 11/1970 Woelfle
4,356,944 A * 11/1982 Cotton ..... 225/5
4,693,232 A * 9/1987 Yasuga
4,770,156 A * 9/1988 Boada Sucarrats
5,175,044 A 12/1992 Arasawa
5,303,690 A * 4/1994 Ishii
5,480,081 A * 1/1996 Wilson et al. ..... 225/96.5
5,662,094 A * 9/1997 Giacomelli
5,762,061 A * 6/1998 Bevan

FOREIGN PATENT DOCUMENTS

| | | |
|---|---|---|
| JP | 01095006 | 4/1989 |
| JP | 6-87085 | 3/1994 |
| JP | 9-1530 | 1/1997 |

* cited by examiner

*Primary Examiner*—Timothy V. Eley
(74) *Attorney, Agent, or Firm*—McDermott Will & Emery LLP

(57) ABSTRACT

A method of producing ceramics base plates is disclosed, comprising forming a continuous flaw on at least one surface of a ceramics sintered base plate from end to end using a flawing tool and dividing the ceramics sintered base plate along the flaw by applying an external force. It is preferred that a blade edge portion of the flawing tool is made of a cemented carbide or diamond. By the method of the invention, the ceramics sintered base plate can be easily divided, and ceramics base plates excellent in dimensional accuracy are obtained without lowering the strength thereof.

6 Claims, 2 Drawing Sheets

CERAMICS BASE PLATE AND METHOD FOR PRODUCING THE SAME

BACKGROUND OF THE INVENTION

1. Field of the Invention

The present invention relates to a method of producing ceramics base plates and specifically to a method of obtaining ceramics base plates by dividing a large ceramics sintered base plate. Also, the invention relates to a ceramics base plate obtained by the method.

2. Description of the Related Art

Hitherto, as methods of dividing a ceramics sintered base plate into plural ceramics base plates dicing with a cutting blade containing grinding stone particles such as diamond, etc. and cutting with laser beams have been generally known. In these methods, in addition to the case of completely A cutting a ceramics sintered base plate, dividing a ceramics sintered-base-plate by applying an external force after half cutting the base plate is also carried out.

Dicing with a cutting blade is most generally carried out. For example, the ceramics sintered base plate is cut while relatively moving the base plate to the X direction and/or the Y direction to the cutting blade. Of the dicing methods, a method of dividing a ceramics sintered base plate by applying an external force after half cutting the base plate to a definite depth enables the restraint of the processing cost as compared with the case of completely cutting by reasons such as high treatment capacity, low abrasion of the cutting blade, etc.

Also, in the case of cutting with laser beams, in general, fine holes are continuously formed in a ceramics sintered base plate upon irradiation with laser beams in a dot-like form. When the formed fine holes penetrate through the ceramics sintered base plate, the ceramics sintered base plate is completely divided at a stretch. On the other hand, when the fine holes do not penetrate through the ceramics sintered base plate, the cutting is of half cutting, and the base plate is then divided by applying an external force. Even in this case, the method of dividing the ceramics sintered base plate after half cutting enables the restraint of the processing cost because the treatment time is generally short as compared with the case of completely dividing the base plate.

In addition, there is also a method, though not so wide spread, in which half cutting is applied to a molding of a ceramics, and the molding is sintered to form a ceramics sintered base plate, which is then divided along the half cut portion.

Of the related art methods as described above, as shown in FIG. 3, in the case of cutting a ceramics sintered base plate 1 by dicing using a cutting blade 3, a portion of the ceramics corresponding to a blade width d of the cutting blade 3 is wasted as swarf. Also, since the abrasion of the cutting blade 3 is severe, diamond is frequently used for the cutting blade. Under such circumstances, in dicing using the cutting blade 3, the drawback is that the processing cost is increased.

Furthermore, in the general method of dividing a ceramics base plate along the half cut groove after half cutting by dicing using a cutting blade 3, because each ceramics base plate 2 obtained by dividing has cut residual portions 2*a* by half cutting as shown in FIG. 4, a deviation in size is generated corresponding to two times, at the largest, the blade width d of the cutting blade 3 to the desired base plate size D. Also, when the cut residual portions 2*a* remain on the ceramics base plate 2, there exist many portions which could become a breakage-starting point, resulting in a fault of relatively lowered breaking strength of the ceramics base plate 2.

Also, in the case of dicing with a cutting blade, a cooling medium such as water is used to prevent heating of the cutting blade or the ceramics art sintered base plate during cutting. If the ceramics sintered base plate is made of aluminum nitride, when the base plate is allowed to stand with water, there is a problem of the generation of ammonia.

On the other hand, because in the case of cutting with laser beams, fine holes are formed upon irradiation with laser beams, even when cutting is of complete cutting or half cutting, a trace by the irradiation with laser beams remains on the obtained ceramics base plate. The trace portion formed by the irradiation with laser beams becomes a breakage-starting point, whereby the strength of the divided ceramics base plates is liable to be lowered. Also, when the heat conductivity of a ceramics base plate is high, the heat by the irradiated laser beams diffuses on the base plate. Therefore, a treatment of prolonging the time for irradiation with laser beams or of increasing the output of laser beams is necessary, resulting in a problem of an increase in the processing cost.

Further, when laser beams are irradiated, the ceramics components, which have not been sublimed completely, attach or weld to the peripheral portions of the fine holes formed by the laser. Because these attached or welded substances are present in a convex form on the ceramics base plate, when, for example, a paste is screen-printed in case of forming a metallized layer of a baking type, defects may occur on the printed pattern or the metallized layer after baking and these attached substances damage the printed pattern, and may possibly result in the breakage of the screen.

In case of the method of applying half cutting to the molding and dividing it after sintering, the dimensional accuracy is lowered, as the size of a ceramics base plate increases, because of a dispersion shrinkage by sintering.

SUMMARY OF THE INVENTION

Under these circumstances, the invention has been made. That is, an object of the invention is to provide a method of producing ceramics base plates, which can be simply applied and can reduce the cost in case of producing plural ceramics base plates by dividing a ceramics sintered base plate, and does not generate substances that attach to surfaces of the ceramics base plates.

Another object of the invention is to provide a ceramics base plate that does not cause the lowering of strength and is excellent in dimensional accuracy as produced according to the method of the invention.

These objects have been attained by the invention as described hereinbelow.

That is, according to an aspect of the invention, there is provided a method of producing ceramics base plates, which comprises forming a continuous flaw on at least one surface of a ceramics sintered base plate from end to end using a flawing tool and dividing the ceramics sintered base plate along the flaw by applying an external force. It is preferred that a blade edge portion of the flawing tool used in the invention be made of a cemented carbide or diamond. Furthermore, a depth of the flaw to be formed is from 1/100 to 1/10 of the thickness of the ceramics sintered base plate. Also, according to another aspect of the invention, there is provided a ceramics base plate obtained by dividing a ceramics sintered base plate, wherein the base plate has a flaw trace of a depth of from 1/100 to 1/10 of the thickness of the ceramics base plate along an edge between a surface of the ceramics base plate and the divided surface.

DETAILED DESCRIPTION OF THE INVENTION

The invention is described below in detail.

Figure 1:
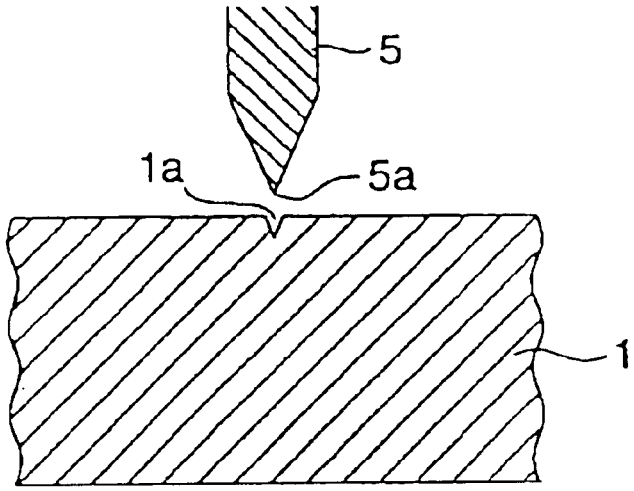
FIG. 1 is a schematic cross-sectional view showing a flawing processing to a ceramics sintered base plate according to the method of the invention.
Figure 2:
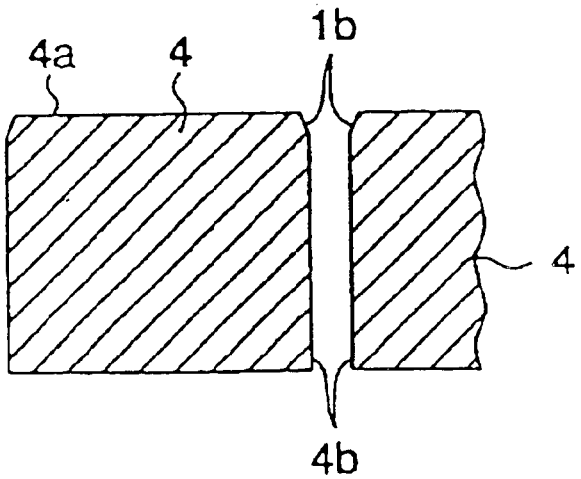
FIG. 2 is a schematic cross-sectional view showing a ceramics base plate divided by the method of the invention.
Figure 3:
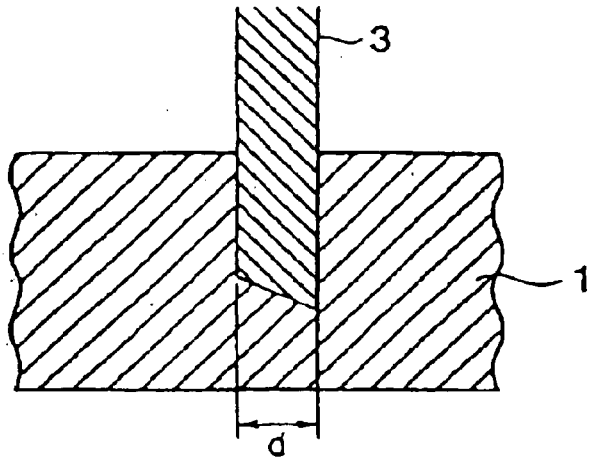
FIG. 3 (PRIOR ART)
FIG. 3 is a schematic cross-sectional view showing dicing of a ceramics sintered base plate with a related art cutting blade.
Figure 4:
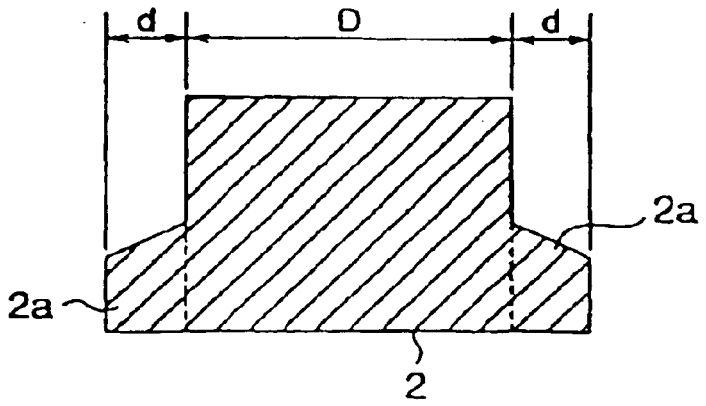
FIG. 4 (PRIOR ART)
FIG. 4 is a schematic cross-sectional view showing a ceramics base plate divided after half cutting by a related art dicing.

In the method of the invention, as shown in FIG. 1, a continuous flaw 1*a* is formed on one surface of a ceramics base plate 1 from end to end of the surface by a blade edge portion 5*a* of a flawing tool 5. When an external force is applied to the flawed ceramics sintered base plate 1, a flaw spreads to the thickness direction of the base plate, wherein the flaw 1*a* acts as the breakage-starting point, and the ceramics sintered base plate 1 is then divided along the flaw 1*a* to obtain plural ceramics base plates 4, as shown in FIG. 2. In this case, though the surface of the ceramics sintered base plate 1 to which the flaw ir; 1*a* is formed may be both surfaces of the base plate, in general, only one surface is sufficient. In case of flawing both surfaces, it is necessary to take notice of position-matching and directional properties of the flaw 1*a* at both the front and back surfaces.

As the flawing tool 5, it is preferred that the blade edge portion 5*a* is made of a hard material such as a cemented carbide (e.g., a WC—Co alloy), diamond, etc., and diamond is particularly preferred because in this case, the strength of the base plate is less lowered. In general, because hard materials such as a cemented carbide, diamond, etc. have a higher hardness than that of ceramics and are excellent in durability, a sharp flaw can be continuously formed on a ceramics sintered base plate 1.

Also, the flaw 1*a* to be formed on the surface of the ceramics sintered base plate 1 by the blade edge portion 5*a* of the flawing tool 5 is far shallower as compared with the case of half cutting by dicing with a related art cutting blade. In the former case, a width of the flaw is also very small. Accordingly, not only can a deviation in size of the obtained ceramics base plates 4 be reduced, but also the time required for forming the flaw can be shortened, and the amount of wasted ceramics as swarf can be considerably lowered. Thus, the processing cost can be reduced.

In the invention, the depth of the flaw 1*a* to be formed on the surface of a ceramics sintered base plate is preferably from 1/100 to 1/10 of the thickness of the ceramics sintered base plate. If the depth of the flaw 1*a* is less than 1/100 of the thickness of the ceramics sintered base plate, sometimes even when an external force is applied, the base plate is not divided along the flaw 1*a*. Also, if the depth of the flaw 1*a* exceeds 1/10 of the thickness of the ceramics sintered base plate, when the ceramics sintered base plate 1 having the flaw 1*a* formed thereon is subjected to screen printing or the like as it is, the ceramics sintered base plate 1 is liable to be broken.

Furthermore, because the flaw 1*a* formed on the surface of the ceramics sintered base plate 1 is in a concave form, even when screen printing with a paste for forming a metallized layer is, for example, carried out, the flaw 1*a* does not damage the printing screen. Therefore, it is possible to apply a treatment such as printing to the surface of the ceramics sintered base plate 1 having the flaw 1*a* formed thereon as it is. Also, because in the method of the invention, the attachment of substances to the surface of the base plate does not occur differently from the case of processing by irradiation with laser beams, a defect by the attached substances does not occur on the metallized layer of the base plate.

As a practical flawing process, the ceramics sintered base plate is placed and fixed on, for example, a stepper, etc., and the flawing tool and the ceramics sintered base plate are relatively moved to the X direction or the Y direction, thereby enabling the carrying out of the flawing process on the ceramics sintered base plate at a definite pitch with good accuracy. Also, in this case, if the load applied to the flawing tool is controlled, the depth of the flaw can be adjusted.

As the ceramics sintered base plate which can be used, an aluminum nitride sintered base plate is particularly preferred. The aluminum nitride sintered base plate is formed from grains of aluminum nitride of about several turn and has a structure where the grains are adhered to each other via a grain boundary phase. Thus, in case of dividing the aluminum nitride sintered base plate having a flaw formed on its surface by applying an external force thereto, the flaw spreads successively while the flaw acts as a breakage-starting point, and the base plate can be easily divided. As the divided surface is very smooth, and consequently the possible breakage-starting points are decreased, the ceramics base plate keeping its inherent strength can be obtained, as opposed to the case of the cutting with laser beams.

In a related art of dicing process of an aluminum nitride sintered base plate, a cooling medium such as water is used for protecting the cutting blade from heat generated by the friction between the base plate and the cutting blade. In this case, when water attaches to the exposed surface of the base plate by dicing without being covered by the oxide film, ammonia may be generated upon the reaction of aluminum nitride with water. However, according to the method of the invention, because it is not necessary to use a cooling medium such as water during the flawing process or at subsequent dividing, even when the ceramics sintered base plate is an aluminum nitride sintered base plate, the generation of ammonia does not occur.

The hardness of the ceramics sintered base plate which is divided by flawing according to the method of the invention is preferably 1,500 Hv or lower in terms of Vickers hardness. If the Vickers hardness of the base plate exceeds 1,500 Hv, even when a ceramics sintered base plate is subjected to the flawing process by a flawing tool, the depth of the flaw formed is liable to become shallow, whereby in the case of dividing the base plate by applying an external force, the base plate is scarcely divided along the form of the flaw and may possibly cause local breakage of the base plate.

According to the invention, as shown in FIG. 1, the ceramics sintered base plate 1 having the flaw 1*a* formed thereon is divided, whereby plural ceramics base plates 4 are obtained as shown in FIG. 2. Since the ceramics base plates 4 obtained by the division are divided to the thickness direction along the flaw 1*a*, a flaw trace 1*b* remains along an edge between the surface 4*a* and the divided surface 4*b* of the ceramics base plate 4. The depth of the flaw trace 1*b* is desirably in the range of from 1/100 to 1/10 of the thickness of the ceramics base plate 4.

The invention is described below in detail with reference to the following Examples. However, it should not be construed that the invention is limited thereto.

EXAMPLE 1

Ceramics sintered base plates each having a size of 50 mm×50 mm and a thickness of 0.635 mm made of aluminum nitride, alumina, and silicon nitride, respectively were prepared. On a surface of each ceramics sintered base plate a flaw was formed using a flawing tool having a blade edge portion of a cemented carbide or artificial diamond. The flaw formed was a linear shallow flaw (depth: 30 μm) extending from end to end of the surface of the base plate, and such flaws were formed on the whole surface of the base plate with a pitch of 5.0 mm. Then, an external force was applied to each ceramics sintered base plate in a direction such that the formed flaw became a breakage-starting point, and the sintered base plate was divided into plural ceramics base plates along the flaws.

Also, each ceramics sintered base plate the same as above was completely divided or divided by applying an external force after half cutting by cutting with laser beams or dicing with a cutting blade at a pitch of 5.0 mm the same as above. In this case, each base plate was irradiated with laser beams at a diameter of 120 μm and a pitch of 120 μm. During half cutting, the time of irradiation with laser beams was controlled such that the laser beams reached from 200 to 250 μm into the base plate. In addition, with respect to the dicing, a cutting blade having a blade width of 0.2 mm was used and the cutting processing; was carried out while pouring water. In the case of half cutting, the depth was 300 μm.

In regard to each of the ceramics base plates thus obtained, the size of the width direction (target: 5.0 mm) after division and the tolerance thereof the three-point bending strength, the printability at screen printing of paste, the presence of breakage of the base plate at dividing, and the presence of the generation of ammonia with respect to the aluminum nitride sintered base plate were evaluated. In this case, for the evaluation of the strength, the ceramics base plate was supported at two supporting points (interval: 30 mm) while the flawed surface side of the ceramics base plate faced the lower side, a load was applied to a middle point between the two supporting points, and the load when the base plate was broken was measured. Also, for the size measurement, the base plate was equally divided into four parts in the lengthwise direction, and the size of the width direction in each of the three points of the respective divided parts was measured. The results obtained are shown in the following tables with respect to each type of the ceramics base plates.

TABLE 1

[Aluminum nitride (Vickers hardness: 1,200 Hv)]

| Dividing method | Mean size (mm) | Mean strength (kg/mm) | Printability | Breakage of base plate | Generation of ammonia |
|---|---|---|---|---|---|
| Dicing with cutting blade*: Half cutting | 5.0 ± 0.21 | 27 | Good | None | Occurred |
| Dicing with cutting blade*: Complete cutting | 5.0 ± 0.03 | 31 | Good | None | Occurred |

TABLE 1-continued

[Aluminum nitride (Vickers hardness: 1,200 Hv)]

| Dividing method | Mean size (mm) | Mean strength (kg/mm) | Printability | Breakage of base plate | Generation of ammonia |
|---|---|---|---|---|---|
| Cutting with laser beams*: Half cutting | 5.0 ± 0.03 | 26 | Screen was damaged | None | None |
| Cutting with laser beams*: Complete cutting | 5.0 ± 0.04 | 25 | Screen was damaged | None | None |
| Use of cemented carbide** | 5.0 ± 0.02 | 34 | Good | None | None |
| Use of diamond** | 5.0 ± 0.02 | 35 | Good | None | None |

*Comparison
**Invention

TABLE 2

[Silicon nitride (Vickers hardness: 1,500 Hv)]

| Dividing method | Mean size (mm) | Mean strength (kg/mm) | Printability | Breakage of base plate |
|---|---|---|---|---|
| Dicing with cutting blade*: Half cutting | 5.0 ± 0.23 | 65 | Good | None |
| Dicing with cutting blade*: Complete cutting | 5.0 ± 0.02 | 68 | Good | None |
| Cutting with laser beams*: Half cutting | 5.0 ± 0.03 | 63 | Screen was damaged | None |
| Cutting with laser beams*: Complete cutting | 5.0 ± 0.03 | 61 | Screen was damaged | None |
| Use of cemented carbide** | 5.0 ± 0.03 | 71 | Good | None |
| Use of diamond** | 5.0 ± 0.03 | 73 | Good | None |

*Comparison
**Invention

TABLE 3

[Alumina (Vickers Hardness 2,000 Hv)]

| Dividing method | Mean size (mm) | Mean strength (kg/mm) | Printability | Breakage of base plate |
|---|---|---|---|---|
| Dicing with cutting blade*: Half cutting | 5.0 ± 0.21 | 28 | Good | None |
| Dicing with cutting blade*: Complete cutting | 5.0 ± 0.03 | 30 | Good | None |
| Cutting with laser beams*: Half cutting | 5.0 ± 0.03 | 29 | Screen was damaged | None |
| Cutting with laser beams*: Complete cutting | 5.0 ± 0.04 | 27 | Screen was damaged | None |
| Use of cemented carbide** | 5.0 ± 0.03 | 34 | Good | One was damaged. |
| Use of diamond** | 5.0 ± 0.03 | 35 | Good | None |

*Comparison
**Invention

As is seen from the above results, in the dividing method of the invention, a higher dimensional accuracy than that in the dicing with a cutting blade is obtained, and plural ceramics base plates can be obtained by easily dividing the ceramics sintered base plate without lowering the strength inherent to the ceramics as compared to the cutting by irradiation with laser beams. Also, it can be seen that the use of the flawing tool having a blade edge portion made of diamond is particularly preferred because of less reduction in the strength of the formed base plates, and no breakage occurs at dividing the ceramics sintered base plate.

EXAMPLE 2

Two kinds of aluminum nitride sintered base plates (size: 50 mm×50 mm) having a different thickness from each other as shown in Table 4 below were prepared. On the surface of each sintered base plate was formed a flaw having the same form as in Example 1 at various depths shown in Table 4 using a flawing tool having a blade edge portion of artificial diamond in the same manner as in Example 1. Then, an Ag paste was subjected to screen printing on the surface of each flawed sintered base plate, and after baking, the sintered base plate was divided by applying an external force while the flaw acted as a breakage-starting point. Five hundred base plates of each of Samples 1 to 10 thus obtained were evaluated for the dividing properties. The results are shown in Table 4.

TABLE 4

| Sample No. | Base plate thickness (mm) | Flaw depth (mm) | Flaw depth/Base plate thickness | Dividing properties |
|---|---|---|---|---|
| 1* | 0.635 | 0.080 | 0.13 | One was broken at printing. |
| 2** | 0.635 | 0.064 | 0.10 | Good |
| 3** | 0.635 | 0.02 | 0.03 | Good |
| 4** | 0.635 | 0.007 | 0.011 | Good |
| 5* | 0.635 | 0.003 | 0.005 | One could not be divided along the flaw. |
| 6* | 1.5 | 0.2 | 0.13 | One was broken at printing. |
| 7** | 1.5 | 0.15 | 0.10 | Good |
| 8** | 1.5 | 0.06 | 0.04 | Good |
| 9** | 1.5 | 0.015 | 0.01 | Good |
| 10* | 1.5 | 0.009 | 0.006 | One could not be divided along the flaw. |

*Comparison
**Invention

As is seen from the results shown in Table 4, almost all of the samples could be divided well. However, in Samples 1 and 6, only one (0.2%) of the 500 base plates was broken by the pressure at screen printing; and in Samples 5 and 10, only one (0.2%) of the 500 base plates could not be divided along the flaw, and the base plate having the desired form was not obtained. Also, all of the base plates divided in the desired form along the flaw were measured for the size (target: 5.0 mm) in the width direction as in Example 1. As a result, it was confirmed that the size was within the range of 5.0±0.03 mm.

As described above, according to the invention, plural ceramics base plates can be produced at a low processing cost by dividing a ceramics sintered base plate, and the ceramics base plates thus obtained are free from lowering the strength and are excellent in dimensional accuracy.

Also, according to the invention, when the ceramics sintered base plate is an aluminum nitride sintered base plate, because the ceramics base plate itself is liable to cause grain boundary breakage, the dimensional accuracy of the base plates obtained increases. Further, because water is not used as a cooling medium, ammonia is not generated. Moreover, in printing of a paste on the ceramics base plates obtained after dividing, no attached substances are present on the surfaces thereof, so there is no possibility of damaging the screen at screen printing.

While the invention has been described in detail and with reference to specific embodiments thereof, it will be apparent to one skilled in the art that various changes and modifications thereof can be made therein with departing from the spirit and scope thereof

What is claimed is:

1. A method of producing ceramics base plates, which comprises:

forming a continuous flaw up to a depth of 1/10 of the thickness of the ceramics sintered base plate on at least one surface of the ceramics sintered base plate from end to end using a flawing tool; and dividing the ceramics sintered base plate along the flaw by applying an external force, wherein a blade edge portion of the flawing tool is made of a cemented carbide or diamond.

2. A method of producing ceramics base plates as claimed in claim 1, wherein the blade edge portion of the flawing tool is made of diamond.

3. A method of producing ceramics base plates as claimed in claim 1, comprising forming the continuous flaw to a depth of from 1/100 to 1/10 of the thickness of the ceramics sintered base plate.

4. A method of producing ceramics base plates as claimed in claim 1, wherein Vickers hardness of the ceramics sintered base plate is 1,500 Hv or lower.

5. A method of producing ceramics base plates as claimed in claim 1, wherein the ceramics sintered base plate is an aluminum nitride sintered base plate.

6. A method of producing ceramics base plates as claimed in claim 1, wherein a cooling medium is not used at forming the flaw on the surface of the ceramics sintered base plate and at dividing the ceramics sintered base plate.

* * * * *